US007551860B2

(12) United States Patent
Kawai

(10) Patent No.: US 7,551,860 B2
(45) Date of Patent: Jun. 23, 2009

(54) IMAGE FORMING APPARATUS INCLUDING A RECOGNITION STRUCTURE FOR RECOGNIZING THE COMPATIBILITY OF AN IMAGE FORMING PROCESS UNIT

(75) Inventor: Hideaki Kawai, Kyoto (JP)

(73) Assignee: Murata Machinery, Ltd., Kyoto (JP)

( * ) Notice: Subject to any disclaimer, the term of this patent is extended or adjusted under 35 U.S.C. 154(b) by 0 days.

(21) Appl. No.: 11/941,166

(22) Filed: Nov. 16, 2007

(65) Prior Publication Data

US 2008/0118254 A1 May 22, 2008

(30) Foreign Application Priority Data

Nov. 17, 2006 (JP) ..... 2006-311363

(51) Int. Cl.
*G03G 15/00* (2006.01)
*G03G 21/18* (2006.01)

(52) U.S. Cl. ..... 399/12; 399/111

(58) Field of Classification Search ..... 399/12, 399/112, 223, 119, 120, 262, 111
See application file for complete search history.

(56) References Cited

U.S. PATENT DOCUMENTS

| | | | | |
|---|---|---|---|---|
| 4,803,521 | A | 2/1989 | Honda | |
| 6,023,594 | A * | 2/2000 | Okiyama et al. | 399/12 |
| 6,505,006 | B1 | 1/2003 | Solanki et al. | |
| 7,382,988 | B2 * | 6/2008 | Nakazato | 399/12 |
| 2007/0223941 | A1 * | 9/2007 | Dawson | 399/12 |

FOREIGN PATENT DOCUMENTS

| | | | |
|---|---|---|---|
| JP | 07-134497 | A | 5/1995 |
| JP | 63-155143 | U | 10/1998 |
| JP | 11-024530 | A | 1/1999 |
| JP | 2001-075455 | A | 3/2001 |
| JP | 2004-029149 | A * | 1/2004 |
| JP | 2004-061898 | A | 2/2004 |
| JP | 2005-114935 | A | 4/2005 |
| JP | 2005-301077 | A | 10/2005 |
| JP | 2006-072166 | A * | 3/2006 |

OTHER PUBLICATIONS

Official communication issued in counterpart Japanese Application No. 2006-311363, mailed on Jan. 6, 2009.

Official communication issued in counterpart European Application No. 07022132.0, mailed on Jan. 8, 2009.

* cited by examiner

*Primary Examiner*—Sophia S Chen
(74) *Attorney, Agent, or Firm*—Keating & Bennett, LLP

(57) ABSTRACT

An image forming apparatus for recognizing compatibility of an image forming process unit to be removably mounted at a given position within a main body of the apparatus, includes an engaging member mounting portion arranged to mount a recognition engaging member thereon, and a projecting member mounting portion arranged to mount thereon a recognition projecting member engageable with a recessed portion provided in the recognition engaging member. The projecting member mounting portion and the recognition engaging member mounting portion are respectively capable of mounting the recognition projecting member and recognition engaging member in two or more mounting states. The recognition projecting member and the recognition engaging member are mounted so as to be capable of being engaged with each other in the two or more mounting states so as to achieve compatibility recognition.

4 Claims, 7 Drawing Sheets

IMAGE FORMING APPARATUS INCLUDING A RECOGNITION STRUCTURE FOR RECOGNIZING THE COMPATIBILITY OF AN IMAGE FORMING PROCESS UNIT

CROSS-REFERENCE TO RELATED APPLICATIONS

This application claims priority under 35 U.S.C. 119 to Japanese Patent Application No. 2006-311363, filed on Nov. 17, 2006, which application is hereby incorporated by reference in its entirety.

BACKGROUND OF THE INVENTION

1. Field of the Invention

The present invention relates to an image forming apparatus such as a fax machine, a copying machine or a printing machine (including a composite machine made of a combination of two or more of these apparatuses) and, specifically, the present invention relates to an image forming apparatus including a recognition structure for recognizing the compatibility of an image forming process unit which is removably mounted at a given position within a main body of the image forming apparatus.

2. Description of the Related Art

In the above-mentioned image forming apparatus, as an image forming process unit, there is used a developing machine main body unit including a developing machine, a drum unit including a photosensitive drum, expendables such as a toner cartridge for storing toner therein, a replaceable part separately or in the form of a package structured by combining together two or more of these elements. That is, the image forming process unit can be removably mounted at a given position within the main body of the image forming apparatus and, as the need arises, it can be replaced with a new one or a replaceable part that can be recycled.

Recently, from a technological viewpoint such as a resolution viewpoint, or from the viewpoint of uses such as an office use or a domestic use, there have been developed two or more kinds of image forming apparatuses. In conformity with such development, or according to the kinds of the performance of the image forming process unit itself, there have been developed two or more kinds of image forming process units.

In this case, a given kind of image forming apparatus must mount an image forming process unit which corresponds to it. When such image forming apparatus mounts an image forming process unit which does not correspond to it, unfavorably, there is a fear that the image forming apparatus can break or the quality of the image formation thereof can be worsened.

In order to recognize whether an individual image forming process unit corresponds to a given kind of image forming apparatus or not, that is, in order to recognize whether the individual image forming process unit is compatible or not, for example, it can be expected to produce an image forming process unit which is changed in shape according to the kind of an image forming apparatus. However, to produce the image forming process unit while changing the shape thereof according to the kind of image forming apparatus leads to the increased cost of the image forming process unit and thus the image forming apparatus incorporating such an image forming process unit therein.

For example, in JP-A-2001-75455, in order to prevent the unauthorized use of non-genuine parts other than manufacturer's genuine parts as replacement parts such as expendables, there is proposed a replaceable part mounting structure in which, not only, on the butting surface of a toner cartridge where the toner cartridge is butted against a hopper portion provided within the apparatus main body, there is provided a convexo-concave shaped portion having a shape copying or corresponding to the registered logo mark of a company which others are prohibited from using, but also, on the hopper portion, there is provided a concavo-convex shaped portion corresponding in shape to the above-mentioned convexo-concave shaped portion, whereby the hopper portion and toner cartridge can be positioned through the concavo-convex engagement between these convexo-concave and concavo-convex shaped portions.

According to the mounting structure disclosed in JP-A-2001-75455, when the apparatus main body and toner cartridge are one to one, the compatibility can be recognized effectively. However, to recognize the compatibility of two or more kinds of image forming process units as described above with the image forming apparatus, the shape of the toner cartridge or the shapes of the convexo-concave and concavo-convex shaped portions must be changed according to the kinds of the image forming process units, which is not preferred from the viewpoint of the cost of the image forming apparatus.

According to JP-A-2005-301077, there is proposed a developing machine in which, at a position near the mounting-direction rear end of the upper surface of a developing machine which can be mounted onto the main body of an image forming apparatus, there are arranged two or more rectangular frame-shaped mounting portions perpendicularly to the mounting direction; a given number of recognition projecting portions for recognizing the compatibility of the developing machine with the apparatus main body are fitted at given positions and fixed there in the mounting portions; in the lower surface of the opening of the apparatus main body where the developing machine can be mounted, specifically, in the positions thereof that correspond to the mounting portions, there are formed recessed portions onto which two or more recognition engaging portions can be mounted; and, the recognition engaging portions are fixed to the recessed portions that do not correspond to the recognition projecting portions fixed to the mounting portions, thereby being able to recognize the compatibility of the developing machine with the apparatus main body. That is, when a developing machine that is incompatible with the apparatus main body is inserted into the image forming apparatus, the recognition projecting portions and recognition engaging portions collide with each other to thereby prevent the developing machine from being inserted into the apparatus main body, which can secure compatibility between the apparatus main body and developing machine.

According to the developing machine, by changing the fixing number and position of the recognition projecting portions and recognition engaging portions, there are possible two or more sets of combinations for recognition of compatibility, whereby the developing machine can be applied according to the kinds of the combination sets without changing the shapes of image forming apparatus and image forming process units themselves.

However, according to the developing machine proposed in JP-A-2005-301077, since the mounting portions must be provided on the upper surface of the developing machine which is limited in space, the number of combination sets for compatibility recognition is also limited and also, between the upper surface of the developing machine and the lower surface of the opening of the apparatus main body, there must be secured a space for the recognition projecting portions and recognition engaging portions, especially, it is necessary to provide a space extending in the height direction of the apparatus main body. This obstructs the formation of a compact structure for the apparatus main body.

SUMMARY OF THE INVENTION

In order to overcome the problems described above, preferred embodiments of the present invention provide an image forming apparatus which, without obstructing the formation of the compact structure of the apparatus main body in the height direction thereof, can easily increase the number of combination sets for compatibility recognition.

According to a preferred embodiment of the present invention, an image forming apparatus for recognizing a compatibility of an image forming process unit to be removably mounted at a given position within a main body of the apparatus includes: an engaging member mounting portion arranged to mount a recognition engaging member thereon and arranged in the mounting direction front end surface of the image forming process unit; a projecting member mounting portion arranged to mount thereon a recognition projecting member engageable with a recessed portion provided in the recognition engaging member and arranged in the inner surface of the apparatus main body to be disposed opposite to the engaging member mounting portion in a state where the image forming process unit is mounted, wherein the projecting member mounting portion and the recognition engaging member mounting portion are respectively capable of mounting the recognition projecting member and recognition engaging member in at least two mounting states; and the recognition projecting member and the recognition engaging member are mounted in such a mounting state so as to be capable of being engaged with each other in the at least two mounting states such that compatibility is recognized.

Here, the term "image forming process unit" means expendables or replaceable parts such as a developing device main body unit including a developing device, a drum unit including a sensitive drum, a toner cartridge for storing supplying toner. In addition, the image forming process unit includes a unit constructed by combining these elements together as a package, or a unit constructed by combining two of these elements together as a package, or a unit composed of only one of these elements.

According to a preferred embodiment of the present invention, the image forming process unit includes at least one of a toner cartridge and a developing device unit.

According to a preferred embodiment of the present invention, a structure is provided in which the engaging member mounting portion includes an opening allowing the developer of the image forming unit to leak therefrom, the recognition engaging member is mounted so as to close the opening and includes a hollow projecting portion in the vicinity of the recessed portion, and, when the projecting portion is cut away, the developer is allowed to leak to the outside.

Also, a structure may be provided in which the recognition projecting member is mounted on the projecting member mounting portion by a fastener, the projecting member mounting portion includes two or more securing holes for securing the fastener thereto, and the two or more securing holes are respectively located at least at the vertices positions of a regular polygon.

According to this structure, preferably, the regular polygon may be a square. Also, the projecting member mounting portion may include a plurality, e.g., nine, securing holes, while four of the securing holes may be respectively formed at the vertices positions of the square and the remaining five holes may be respectively disposed at equidistant positions from the vertices positions. Also, the recognition projecting member may have a substantially L-shaped configuration when viewed from above so as to correspond to three of the securing holes, and the recessed portion of the recognition engaging member may be formed so as to correspond to the shape of the recognition projecting member.

According to the image forming apparatus of a preferred embodiment of the present invention, in the mounting direction front end surface of the image forming process unit, there is provided an engaging member mounting portion for mounting a recognition engaging member thereon, and, in the inner surface of the apparatus main body to be disposed opposite to the engaging member mounting portion in a state where the image forming process unit is mounted, there is provided a projecting member mounting portion for mounting thereon a recognition projecting member engageable with a recessed portion formed in the recognition engaging member. This structure eliminates a possibility that the saving of the space of the apparatus main body in the height direction thereof can be obstructed. Also, since the recognition projecting member and recognition engaging member are respectively mounted in two or more mounting states, even when they have the same shape, there are possible two or more sets of combinations for recognition of compatibility, which can provide an advantage that the number of parts used in the image forming process unit as well as the cost thereof can be reduced.

Also, when the image forming process unit includes at least one of a toner cartridge and a developing device unit, the image forming process unit can be suitably used in a preferred embodiment of the present invention, because, especially, they are often developed so as to correspond to two or more kinds of image forming apparatuses to be developed from the technological viewpoint such as the resolution or from the viewpoint of an office use or a domestic use, or according to the kinds of the performance of the image forming process unit itself.

According to a preferred embodiment of the present invention, especially, in a case where the engaging member mounting portion includes an opening allowing the developer of the image forming unit to leak therefrom, the recognition engaging member is mounted so as to close the opening and includes a hollow projecting portion in the vicinity of the recessed portion, and, when the projecting portion is cut away, the developer is allowed to leak to the outside, when, in order to mount an incompatible image forming process unit, the projecting portion of the recognition engaging member is cut away, the developer is allowed to leak to the outside and is difficult to use, thereby being able to reduce the change of the shape of the recognition engaging member.

Further, in a case where the recognition projecting member is mounted on the projecting member mounting portion by a fastener, the projecting member mounting portion includes two or more securing holes for securing the fastener thereto, and the two or more securing holes are respectively formed to be situated at least at the vertices positions of a regular polygon, even when the recognition projecting member and recognition engaging member are respectively formed in the same shape, there can be obtained at least such number of sets of combinations for compatibility recognition as corresponds to the number of the vertices of the regular polygon. For example, when the regular polygon is an equilateral triangle, since it has three vertices, three sets of combination are possible; for a square, since it has four vertices, four sets of combination are possible; and, for a regular pentagon, since it has five vertices, five sets of combination are possible. This provides an advantage that not only the number of parts but also the cost of the compatibility recognition structure can be reduced.

In this case, especially, it is preferable that the regular polygon is a square; the projecting member mounting portion includes nine securing holes, while four of the securing holes are respectively formed at the positions of the vertices of the square and the remaining five holes are respectively disposed at equidistant positions from the positions of the vertices; the recognition projecting member preferably have a substantially L-shaped configuration when viewed from above so as to correspond to three of the securing holes; and, the recessed portion of the recognition engaging member is formed so as to correspond to the shape of the recognition projecting member. According to this structure, since the number of vertices is four, there are possible four sets of combinations for recognition of compatibility and thus, similarly to the above-mentioned structure, there can be provided an advantage that the number of parts of the structure as well as the cost thereof can be reduced. Also, since the recessed portion of the recognition engaging member preferably has a substantially L-shaped configuration when viewed from above in correspondence to the shape of the recognition proving member to thereby be able to provide at least four patterns for forming the recognition engaging member, even when the shape of the recognition projecting member is unchanged, simply by changing the shape of the recognition engaging member, the number of sets of combinations for recognition of compatibility can be increased, thereby being able to provide an advantage that the number of parts of the structure as well as the cost thereof can be reduced.

Other features, elements, processes, steps, characteristics and advantages of the present invention will become more apparent from the following detailed description of preferred embodiments of the present invention with reference to the attached drawings.

BRIEF DESCRIPTION OF THE DRAWINGS

FIG. 3A is a schematic longitudinal section view taken along the Y-Y line shown in FIG. 2, and FIG. 3B is a partially enlarged exploded perspective view of the inner surface of the apparatus main body.

FIG. 4A is a schematic longitudinal section view taken along the Z-Z line shown in FIG. 2, FIG. 4B is a partially enlarged exploded perspective view of the mounting direction front end surface of the image forming process unit, and FIG. 4C is a schematic transverse section view taken along the W-W line shown in FIG. 4A.

DETAILED DESCRIPTION OF THE PREFERRED EMBODIMENTS

Now, description will be given below of the best mode for carrying out the invention with reference to the accompanying drawings.

Figure 1:
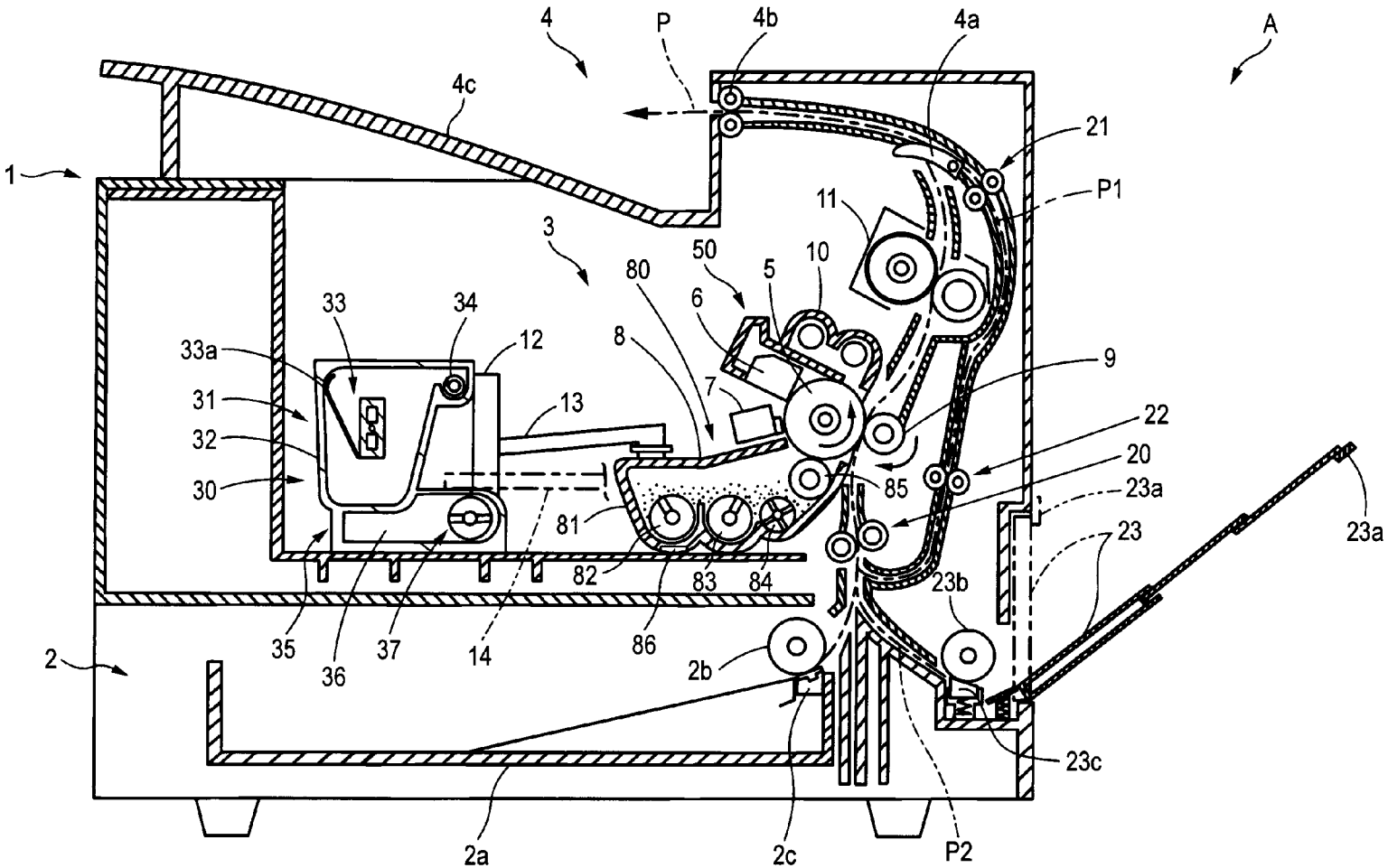
FIG. 1 is a schematic longitudinal section view of an image forming apparatus according to a preferred embodiment of the present invention.
Figure 2:
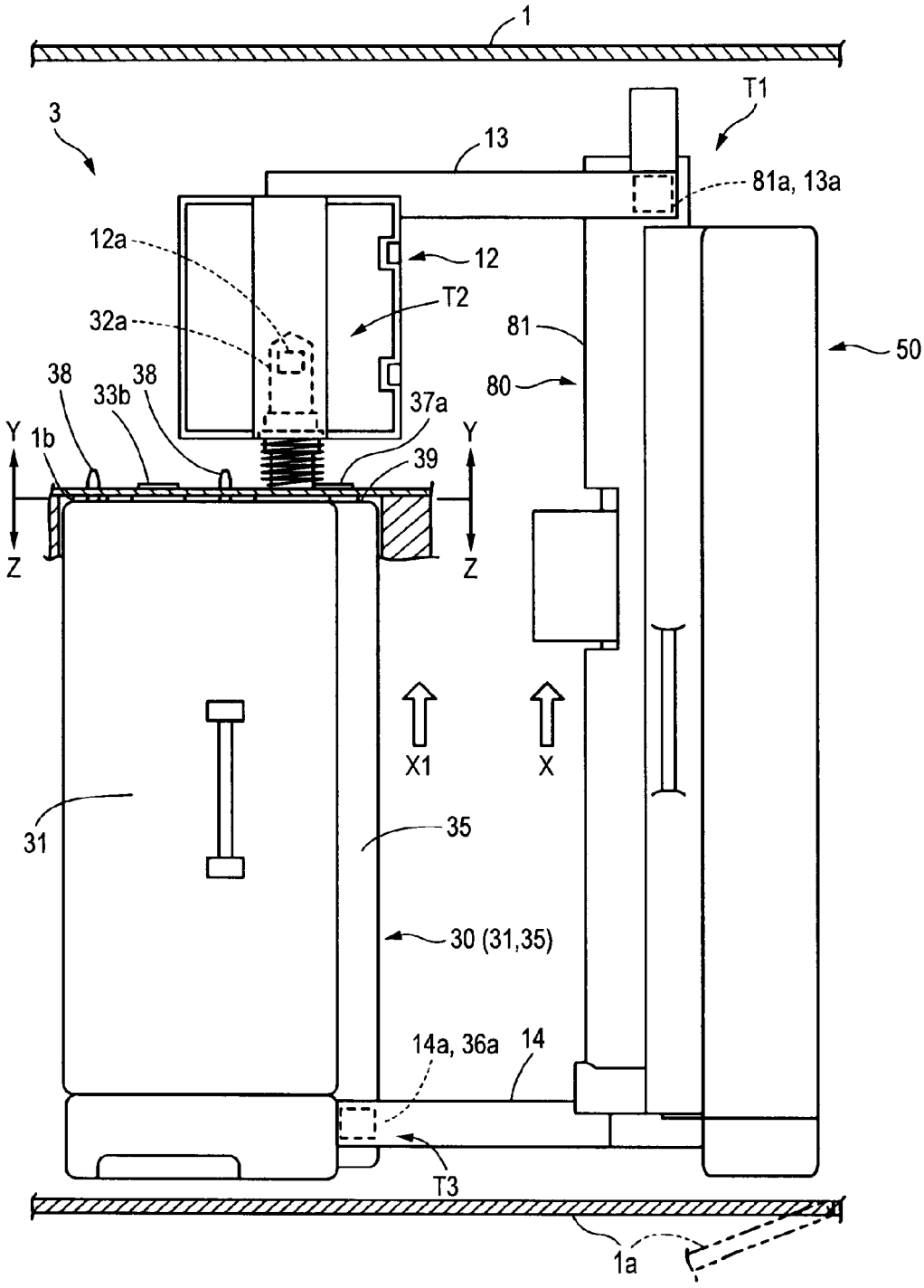
FIG. 2 is a schematic plan view of a portion of an image recording part of the image forming apparatus including an image forming process unit.
Figure 3A:
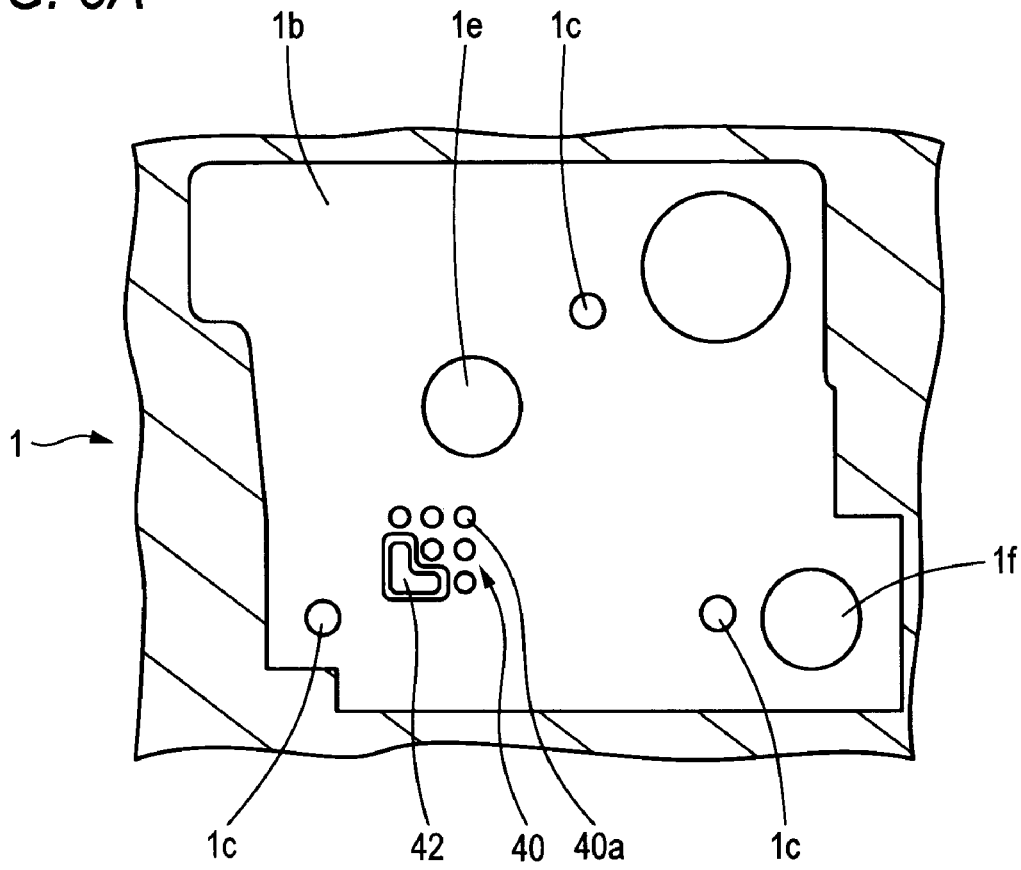
FIGS. 3A and 3B are views of the inner surface of a main body of the image forming apparatus.
Figure 3B:
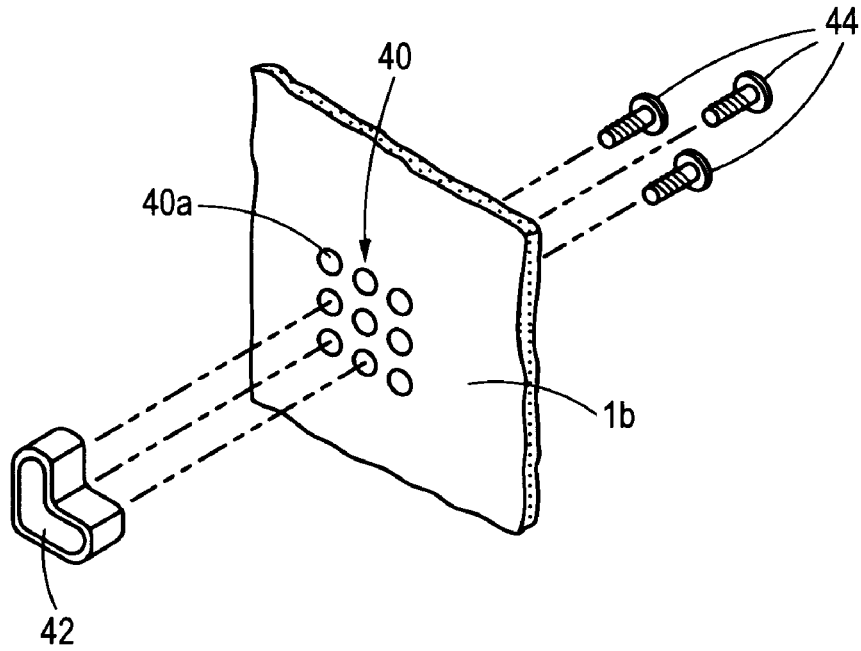
Figure 4A:
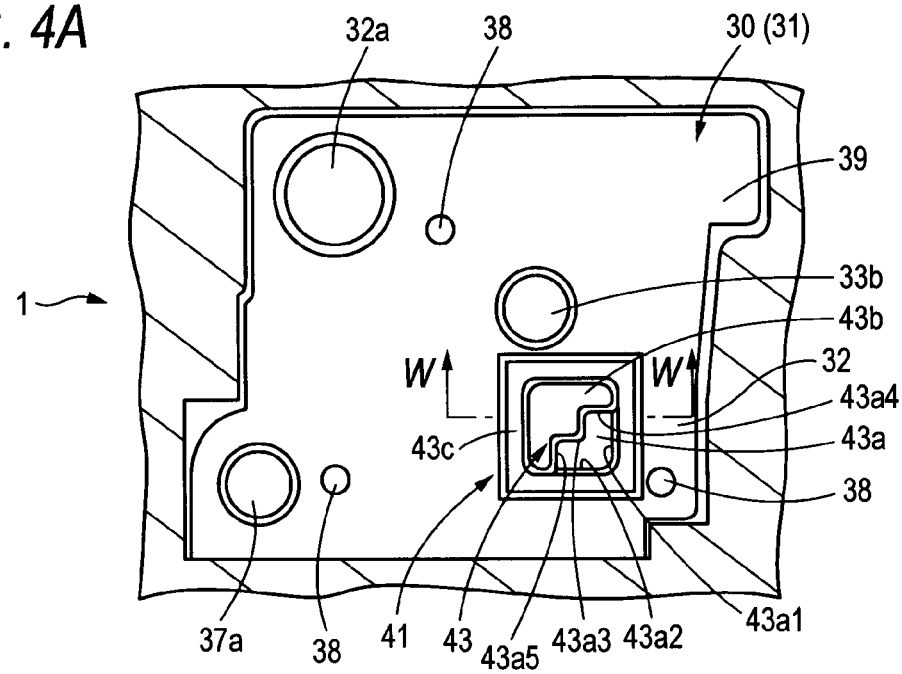
FIGS. 4A to 4C are views of the mounting direction front end surface of an image forming process unit (toner cartridge) mounted into the apparatus main body.
Figure 4B:
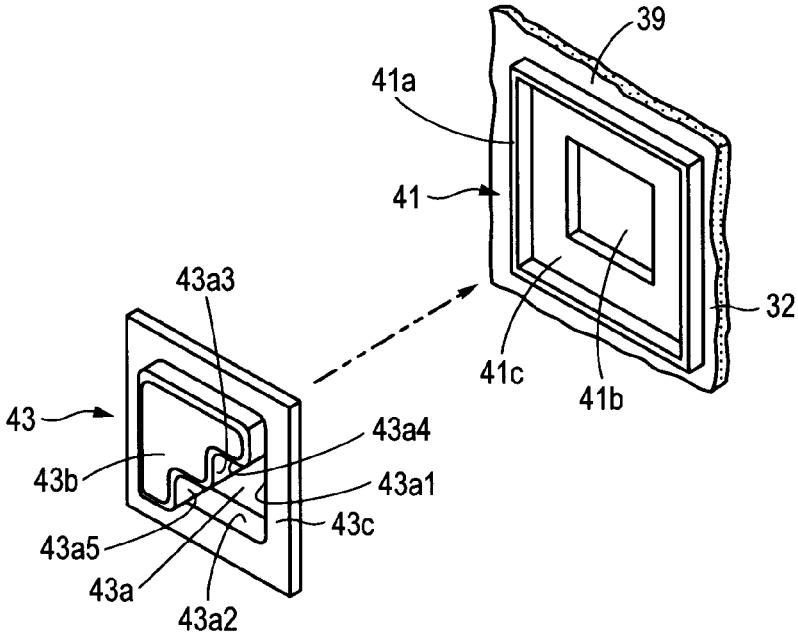
Figure 4C:
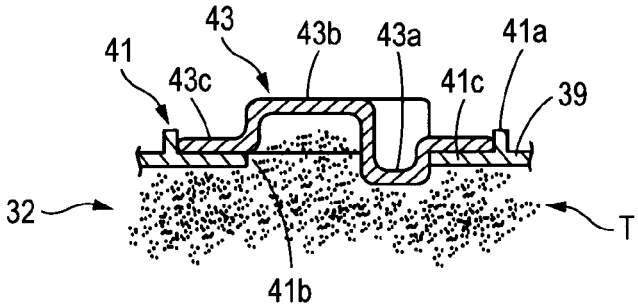
Figure 5A:
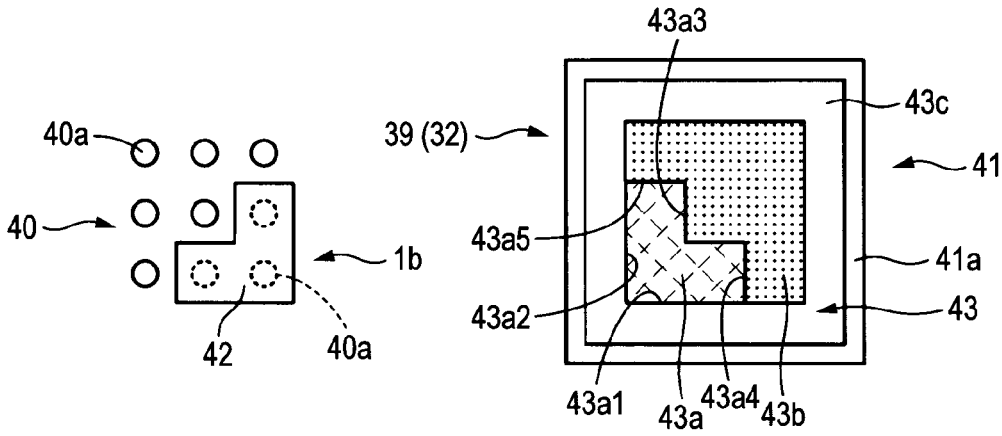
FIGS. 5A, 5B and 5C are schematic typical plan views of a recognition engaging member and a recognition projecting member according to a preferred embodiment of the present invention, showing other mounting states thereof.
Figure 5B:
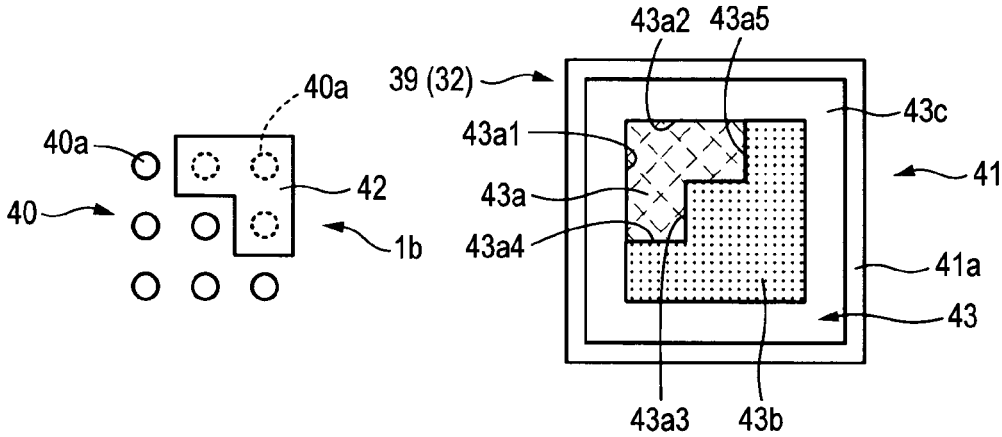
Figure 5C:
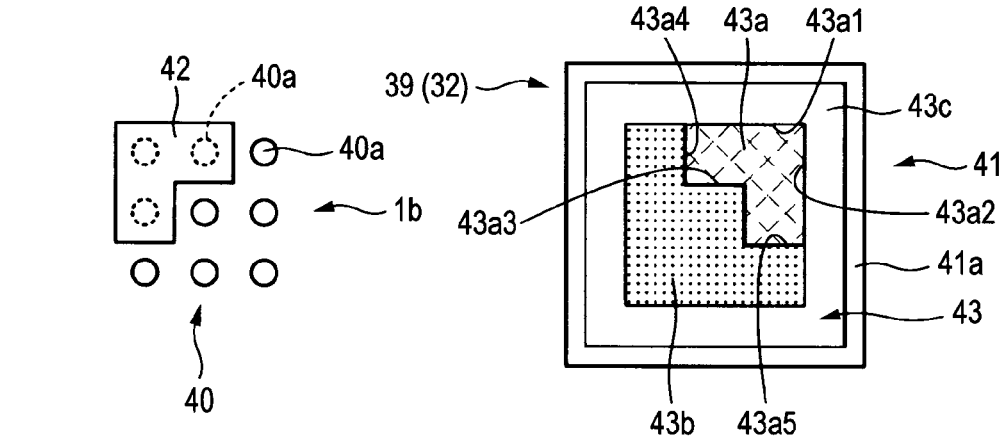

FIG. 1 is a schematic longitudinal section view of a preferred embodiment of an image forming apparatus according to the present invention. FIG. 2 is a schematic plan view of a portion of an image recording part including an image forming process unit incorporated in the image forming apparatus. FIGS. 3A and 3B show the inner surface of a main body of the image forming apparatus: specifically, FIG. 3A is a schematic longitudinal section view taken along the Y-Y line shown in FIG. 2; and, FIG. 3B is a partially enlarged exploded perspective view of the inner surface of the main body of the image forming apparatus. FIGS. 4A to 4C show the mounting-direction front end surface of the image forming process unit mounted on the main body of the image forming apparatus: specifically, FIG. 4A is a schematic longitudinal section view taken along the Z-Z line shown in FIG. 2; FIG. 4B is a partially enlarged exploded perspective view of the mounting direction front end surface of the image forming process unit; and, FIG. 4C is a schematic transverse section view taken along the W-W line shown in FIG. 4A. FIGS. 5A, 5B and 5C are respectively schematic plan views to typically show other mounting states of a recognition engaging member and a recognition projecting member preferably included in the present preferred embodiment.

By the way, in FIGS. 5A to 5C and FIGS. 6A to 7C which will be discussed later, there are typically shown the recognition projecting member and recognition engaging portion in such a manner that the corners thereof are not processed or rounded but they have angular shapes. Also, a recessed portion formed in the recognition engaging portion is shown by cross hatchings, whereas a projecting portion is shown by spots.

An image forming apparatus A shown in FIG. 1 preferably is a printer which includes an electrographic type recording part. However, this is not limitative but there may also be used a copying machine having an image read function, or a so called composite machine having a fax function or having both the image read function and fax function, or the like.

In FIG. 1, the apparatus main body 1 of the image forming apparatus A includes a sheet feed part 2 for feeding a recording sheet (sheet), an electrophotographic type image recording part 3, a sheet discharge part 4 into which the recording sheet is to be discharged after printed, while these parts are superimposed on top of each other in the height direction in this order.

The sheet feed part 2 for feeding a sheet includes an insertable and removable sheet feed cassette 2*a* capable of accumulating and storing a large number of recording sheets therein, a separating sheet feed roller 2*b* disposed on the sheet feed direction front end portion of the sheet feed cassette 2*a*, and a separating pad 2*c* to be elastically contacted with the peripheral surface of the separating sheet feed roller 2*b*.

Here, there may also be used a structure in which, downwardly of the sheet feed cassette 2*a*, there is or are arranged one similar cassette or two or more similar cassettes to thereby provide a multiple stage cassette, or, there is arranged an optional cassette (not shown). Also, instead of the separating pad 2*c*, there may also be used a retard roller.

The image recording part 3 preferably includes: an image forming process part disposed in the periphery of a sensitive drum and including a corona charge type charger 6, an exposure device 7 including an LED or the like, a developing device main body 8, a transfer roller (transfer device) 9, and a cleaning device 10 for cleaning toner remaining after transfer respectively arranged in this order; a fixing device 11 disposed downstream of the image forming process part; and, a toner hopper 12 and a toner cartridge 30 which are respectively disposed spaced apart from the developing device main body 8.

The image forming process part, except for the exposure device 7 and transfer roller 9, functions as a process unit preferably including a drum unit 50 structured as a package including the sensitive drum 5, a charger 6 and cleaning device 10; and, a developing device main body unit 80 structured as a package including a developing device main body housing 81, stir-and-carry screws 82, 83, a supply paddle 84, a developing roller 85 and the like.

The illustrated developing device main body unit 80, which is a developing device a using two-component developer, is structured such that toner and carriers are stored within a developing device main body housing 81 functioning also as a resin-molded developer container, and, while stirring and carrying the toner and carriers by the two parallel-arranged stir-and-carry screws 82 and 83, the developer is supplied by the supply paddle 84 to the bias-applied developing roller 85. On the outer surface of the developing device main body housing 81, there is mounted a magnetic sensor 86; and, the magnetic sensor 86 is used to detect the toner density (the mixture ratio of the toner and carrier) within the developing device main body housing 81. At the positions that are spaced from the developing device main body unit 80, there are disposed a toner tank 31 and toner hopper 12 for toner supply both of which will be discussed later. When it is detected by the magnetic sensor 86 that the toner density within the developing device main body housing 81 has been lowered, the toner is supplied through a screw conveyer (pipe screw) 13 into the developing device main body housing 81 by the toner hopper 12.

By the way, according to the present preferred embodiment, as described above, there is illustrated a developing device of a system preferably using a two-component developer. However, this is not limitative and the present invention can also be applied to a developing device of a system using a one-component developer.

The toner cartridge 30 is removably mounted on the apparatus main body 1 and preferably includes the supplying toner tank 31 and a discharging toner tank 35 which are formed as an integral body. Specifically, the supplying toner tank 31 includes a supplying toner housing 32, in which toner for supply is previously filled and stored, a toner carry and discharge screw 34 disposed upwardly of the inside portion of the supplying toner housing 32, and an agitator 33 which not only stirs up or agitates the toner but also supplies the toner to the toner carry and discharge screw 34. The agitator 33 includes an agitating blade seat 33*a* made of flexible resin material and, owing to the agitating blade seat 33*a*, the toner can be supplied to the toner carry and discharge screw 34 such that the toner is pushed upward.

The discharging toner tank 35 is disposed downwardly of the supplying toner tank 31. The discharging toner tank 35 preferably includes a discharging toner housing 36 having an internal space which spreads out in the direction of the horizontal surface area thereof; a discharging toner receiving opening 36*a* (see FIG. 2) which is opened up in the upper portion of the discharging housing 36 existing in the vicinity of one end portion of a discharging toner feed screw 37 (which will be discussed below) and receives the discharging toner; and, a discharging toner feed screw 37 which is disposed along one of the inner walls of the discharging toner housing 36 and feeds the discharging toner received from the discharging toner receiving opening 36*a*.

Alternatively, instead of the above-described structure in which the toner cartridge 30 includes the discharging toner tank 35 and supplying toner tank 31 formed as an integral body, these elements may also be structured as separate elements and they may be removably mounted on the apparatus main body 1 individually.

The drum unit 50 and developing device main body unit 80 are removably mounted onto the apparatus main body 1 from the front surface side thereof individually or in a state where they are connected together by a suitable connecting element. Also, all constituent elements of the image forming process part, except for the exposure device 7 and transfer roller 9, can also be bundled up together to thereby provide a process unit. Further, the toner cartridge 30 is also removably mounted onto the apparatus main body 1 from the front surface side thereof.

These process units 50, 80 and toner cartridge 30 are preferably define the image forming process unit and, as the expendables, they can be replaced with new ones or recycled ones as the need arises. According to the present preferred embodiment, there is illustrated the image forming process unit in which the toner cartridge 30 is structured as a single unitary element.

Here, the front surface side of the apparatus main body 1 means the side of the sheet shown in FIG. 1. The sheet feed cassette 2*a* can also be inserted into and removed from the apparatus main body 1 from the front surface side thereof.

To the discharging toner tank 35 which constitutes the toner cartridge 30, there is connected a screw conveyor 14 which is used to sequentially carry and throw discharging toner, which is removed and collected by the cleaning device 10, into the discharging toner tank 35. The discharging toner, which has been discharged and thrown from a discharging toner discharge opening 14*a* (see FIG. 2) formed in the screw conveyor 14, is then fed into the discharging toner tank 35 by the discharging toner feed screw 37.

Description will be given later of the details of a toner carry system and a discharging toner carry system which are constituted by connecting together the developing device main body unit (process unit) 80 including the developing device main body 8, drum unit (process unit) 50 and toner cartridge 30, and toner hopper 12.

Downstream of the fixing device 11, there are disposed a switching gate 4*a*, a pair of discharge rollers 4*b* and a discharge tray 4*c* sequentially, while they cooperate together in constituting the discharge part 4. In the vicinity of the upstream side of the image forming process part, there is disposed a pair of resist rollers 20. The recording sheets (sheets), which have been separated and played out one by one from the sheet feed cassette 2*a* due to the operations of the separating sheet feed roller 2*b* and separating pad 2*c*, are introduced to the engaging portion between the sensitive drum 5 and transfer roller 9. While the sensitive drum 5 is rotating in the arrow direction shown in FIG. 1, the surface of the sensitive drum 5 is uniformly minus charged by the charger 6, and an optical image based on image information is radiated onto the surface of the sensitive drum 5 by the exposure device 7, whereby an electrostatic latent image is formed on the surface of the sensitive drum 5. This electrostatic latent image is formed such that, owing to the characteristic of the photo-electric conductor of the surface of the sensitive drum 5, the potential of the light radiated portion of the surface of the sensitive drum 5 is varied but the potentials of the remaining portions thereof are left unvaried.

The electrostatic latent images are developed sequentially by the bias-applied developing device main body 8 and are then transmitted as toner images to the engaging portion between the sensitive drum 5 and transfer roller 9. In the developing operation, to the portion the potential of which has been varied due to the radiation of the light, there is attracted the toner due to the difference in potential between the portion and developing device main body 8, whereby the portion provides a black portion; to the remaining portions, the toner is not attracted, whereby the remaining portions provide white portions. As a whole, there is formed a black and white image based on the image information. The pair of resist rollers 20 is driven and rotated while it is resist controlled such that the recording sheets can be guided to the engaging portion between the sensitive drum 5 and transfer roller 9 in synchronization with the formation of the toner image on the surface of the sensitive drum 5.

While the transfer roller 9, to which a bias has been applied, is being engaged with the sensitive drum 5 and is being driven and rotated in the arrow mark direction (in the width direction of the sensitive drum 5), it nips and carries the recording sheet. During this, the toner image on the surface of the sensitive drum 5 is transferred to the recording sheet. Toner or the like (in some cases, there can be included sheet powder) left on the surface of the sensitive drum 5 is removed and collected by the cleaning device 10. The recording sheet with the toner image transferred thereto is introduced into the fixing device 11, where the toner image is fixed as a permanent image. After that, the switching gate 4*a* is pushed up and the recording sheet is discharged through the pair of discharge rollers 4*b* onto the discharge tray 4*c*. This sequence of recording sheet feeding operations is carried out along a main feed path P which rises substantially vertically (perpendicularly) just after the recording sheet is fed out from the sheet feed cassette 2*a* and, in the pair of discharge rollers 4*b*, makes a U-turn in the direction about 180 degrees with respect to the feed-out direction of the recording sheet from the sheet feed cassette 2*a*. With this unique layout structure, the image forming apparatus can be made compact as a whole.

The illustrated image forming apparatus A has a double-sided recording function and includes a reversal feed path P1 which starts at the mounting position of the switching gate 4*a* of the main feed path P and circulatingly joins the main feed path P on the upstream side of the pair of resist rollers 20. The pairs of resist rollers 20 can be rotated forwardly and reversely and, in the reverse feed path P1, there is disposed a pair of carry rollers 21, 22. For double-sided recording, the recording sheet, on one side of which the image has been recorded in the above-mentioned manner, is carried along the main feed path P and, when the rear end of the recording sheet arrives at the pair of the discharge rollers 4*b*, the pair of discharge rollers 4*b* stop once and nip the rear end of the recording sheet between them. Next, the pair of discharge rollers 4*b* rotates reversely, and the recording sheet is transported from its rear end into the reversal feed path P1 by the pair of carry rollers 21, 22. The recording sheet is transported along the reversal feed path P1, and then enters into the main feed path P and reaches the pair of resist rollers 20. The recording sheet is resisted by the pair of resist rollers 20 and is introduced again to the engaging portion between the sensitive drum 5 and transfer roller 9, where an image is recorded on the other side of the recording sheet. After that, the recording sheet with the images recorded on its both sides, similarly to the above-mentioned manner, is discharged along the main feed path P onto the discharge tray 4*c*.

The illustrated image forming apparatus A further has a manual insertion function to insert a recording sheet by hand and, for this purpose, on the side portion of the apparatus main body 1, there is provided a manual insertion sheet feed tray 23 which not only can be opened and closed but also can be slided, that is, can be extended and contracted in three stages. When not in use, the manual insertion sheet feed tray 23 is closed in a state where it is contracted as shown by a two-dot chained line in FIG. 1; and, when in use, it is opened using a handle 23*a* and is extended properly according to the size of a recording sheet to be placed thereon for feeding. On the front end portion of the manual insertion sheet feed tray 23, there are provided a manual insertion separating sheet feed roller 23*b* and a separating pad 23*c* such that they are elastically contacted with each other. On the further downstream side of them, continuously with them, there is provided a manual insertion feed path P2 which joins the main feed path P.

The manual insertion feed path P2 is structured such that the recording sheet can rise obliquely upward just after it is played out due to the frictional action of the manual insertion separating roller 23*b* and separating pad 23*c* until it arrives at the joining portion of the manual insertion feed path P2 with the main feed path P. This structure makes it possible to make compact the whole of the image forming apparatus.

Next, description will be given below of a toner carry system constituted by connecting together a process unit including the developing device main body 8 (the developing device main body unit 80 and drum unit 50), supplying toner tank 31, toner hopper 12 and discharging toner tank 35. On the deep side (on the upper side of the sheet of FIG. 2) of the apparatus main body 1, there are fixedly disposed the toner hopper 12 and the toner supplying screw conveyor 13 which is connected to the discharge side of the toner hopper 12. The drum unit 50 and developing device main body unit 80, which cooperate together in constituting the process unit, are removably mounted on the apparatus main body 1 such that the two units are connected together in the vertical direction (see FIG. 1) as an integral body; and also, the unified two units can be mounted onto the apparatus main body 1 along the direction of the white arrow mark X shown in FIG. 2 from the front surface side (the lower side of the sheet of FIG. 2) of the apparatus main body 1. Owing to this mounting, the toner receiving opening 81*a* of the developing device main body housing 81 and the toner supply opening 13*a* of the screw conveyor 13 are connected to each other, thereby forming a first toner delivery portion T1.

Also, the toner cartridge 30, which is an integral body of the supplying toner tank 31 and discharging toner tank 35, can also be removably mounted onto the apparatus main body 1 and, specifically, it can be mounted along the direction of the white arrow mark X1 shown in FIG. 2 from the front surface side (the lower direction of the sheet surface of FIG. 2). The two white arrow mark directions X and X1 are the same in direction. Owing to this mounting, the front end portion of the supplying toner tank 31, that is, a cylindrical-shaped toner supply tube 32*a* which is provided on and projected from the mounting direction front end surface 39 of the toner cartridge 30 and the toner receiving portion 12*a* of the toner hopper 12 are connected to each other, thereby constituting a second toner delivery portion T2. Also, in this mounting operation, the discharging toner discharge opening 14*a* of the screw conveyor 14 for carrying the discharging toner from the cleaning device 10 (see FIG. 1) is connected to the discharging toner receiving opening 36*a* of the discharging toner tank 35 to thereby constitute a third toner delivery portion T3. In this manner, there are constituted not only the supplying toner carry system for supplying the toner from the supplying toner tank 31 to the developing device main body housing 81 but also the discharging toner carry system for carrying the discharging toner from the cleaning device 10 to the discharging toner tank 35.

The process unit 50, 80 and toner cartridge 30 can be mounted onto and removed from the apparatus main body 1 from the front surface side of the apparatus main body 1 by opening an opening and closing door 1*a* provided on the front surface side of the apparatus main body 1.

In FIG. 2, reference character 33*b* designates a coupling connected to the drive shaft of the agitator 33, and 37*a* designates a coupling connected to the drive shaft of the discharging toner feed screw 37, while they are respectively provided on and projected from the mounting direction front end surface 39 of the toner cartridge 30 (see FIG. 4A). Also, these two couplings 33*b* and 37*a* can be connected to a drive source (not shown) provided within the apparatus main body 1 through openings 1*e*, 1*f* (see FIG. 3) formed in the inner surface 1*b* (to be discussed later) of the apparatus main body 1 according to the above-mentioned manner of mounting.

Also, in FIG. 2, reference numeral 38 designates a positioning projection which is provided on and projected from the mounting direction front end surface 39 of the toner cartridge 30. The number of the positioning projections 38 preferably are three (see FIG. 4A), for example. The three positioning projections 38 are respectively inserted into their associated positioning holes 1*c*, 1*c* and 1*c* (which will be discussed later) formed in the apparatus main body inner surface 1*b* according to the above-mentioned manner of mounting, thereby positioning the toner cartridge 30 and apparatus main body 1.

According to the above-mentioned toner carry system, the process unit 50, 80 and toner cartridge 30 are both disposed on the same horizontal position (see FIG. 1) within the apparatus main body 1 and thus do not obstruct the formation of the compact structure of the apparatus main body 1; and also, from the viewpoint of a user, since they are arranged on the same horizontal position, when they are mounted onto and removed from the apparatus main body 1, the efficiency of the mounting and removing operation can be enhanced.

Although not shown, at the toner delivery portions T1, T2 and T3, there is interposed a shutter member which can be open when the above-mentioned connection between the toner supply and receive openings is established.

Also, the toner hopper 12, although not described in detail, is used to provisionally store the toner supplied from the supplying toner tank 31. In brief, when the magnetic sensor 86 of developing device main body 8 sends out a toner absence signal, the screw conveyor 13 connected to the toner hopper 12 is actuated, whereby the toner is supplied into the developing device main body housing 81 by the first toner delivery portion T1. The amount of toner to be stored in the toner hopper 12 is set for an amount sufficient to continue a print operation also during the time, for example, when the toner within the supplying toner tank 31 runs out and the currently used toner cartridge 30 is replaced with a new one.

Next, description will be given below of a compatibility recognition structure for recognizing the compatibility of the image forming process unit to be mounted onto the image forming apparatus A according to the present preferred embodiment with reference to FIGS. 3A to 4C.

On the mounting direction front end surface 39 of the toner cartridge 30, as shown in FIG. 4A, there is formed an engaging member mounting portion 41 on which a recognition engaging member 43 can be mounted; and, in the apparatus main body inner surface 1*b* which faces the engaging member mounting portion 41 in a state where the toner cartridge 30 is mounted, as shown in FIG. 3A, there is formed a projecting member mounting portion 40 on which a recognition projecting member 42 to be engaged with a recessed portion 43*a* formed in the recognition engaging member 43 can be mounted.

According to the present preferred embodiment, the engaging member mounting portion 41 is formed at a position which corresponds to the supplying toner tank 31 of the toner cartridge 30, that is, in the mounting direction front end surface of the supplying toner housing 32.

The projecting member mounting portion 40, which includes two or more securing holes 40*a*, can be mounted in two or more mounting states (which will be discussed later) by securing the recognition projecting member 42 to a given one of the securing hole 40*a*.

Also, the two or more securing holes 40*a* are disposed in such a manner that they are respectively situated at least at the positions of the vertices of a regular polygon, according to the present preferred embodiment, the four vertices of a square.

Specifically, according to the present preferred embodiment, the projecting member mounting portion 40 preferably includes nine securing holes 40*a*; and, of the nine securing holes 40*a*, four securing holes 40*a* are respectively formed so as to be situated at the positions of the four vertices of a square, and the remaining five securing holes 40*a* are respectively disposed at substantially equidistant positions from the respective four vertices.

The recognition projecting member 42 preferably has a substantially L-shaped configuration when it is viewed from above so as to correspond to three of the nine securing holes 40*a* and, as shown in FIG. 3B, the recognition projecting member 42 can be fixed to the apparatus main body inner surface 1*b* through the securing holes 40*a* from the back surface of the apparatus main body inner surface 1*b* by three screws 44 constituting fastening elements.

By the way, in the illustrated preferred embodiment, a structure is provided in which the recognition projecting member 42 is secured to the apparatus main body inner surface 1*b* preferably using the three screws 44, for example. However, alternatively, the recognition projecting member 42 may also be secured using one or two screws. Also, instead of forming the securing holes and using the screws, the recognition projecting member 42 may also be secured to the apparatus main body inner surface 1*b* by any other securing method such as by adhesion or by welding, provided that it can prevent the recognition projecting member 42 from being removed easily.

The engaging portion mounting portion 41, as shown in FIG. 4B, includes a mounting frame 41*a* projected in a square shape from the mounting direction front end surface 39 of the toner cartridge 30, and an opening 41*b* opened up inside the mounting frame 41*a*, with a welding margin 41*c* for welding the recognition engaging member 43 left, through which the toner (developer) of the toner cartridge 30 (supplying toner tank 31) can leak, thereby being able to mount the recognition engaging member 43 in two or more mounting states (which will be described later).

The opening 41*b* is formed to have a square shape concentric with the mounting frame 41*a*, while the welding margin 41*c* to be formed between the opening 41*b* and mounting frame 41*a* is formed in the periphery of the opening 41*b* with uniform width.

The recognition engaging member 43 preferably has a substantially square shape as a whole which can be fitted with the mounting frame 41*a* and also can close the opening 41*b*. The recognition engaging member 43 includes a square-shaped frame body 43*c* to be integrally piled on top of the welding margin 41*c* by welding, a recessed portion 43*a* formed inside the frame body 43*c* and recessed inwardly of the supplying toner housing 32, and a projecting portion 43*b* formed adjacent to the recessed portion 43*a* and projected in the opposite direction of the recessed portion 43*a*.

The recessed portion 43*a* is formed within the frame of the frame body 43*c* and preferably has such a substantially L-shaped configuration when it is viewed from above that the two bent outer sides 43*a*1 and 43*a*2 thereof follow the frame body 43*c*.

The projecting portion 43*b* is formed to have a stepwise shape which is enclosed not only by the bent inner sides 43*a*3 and two end sides 43*a*4, 43*a*5 of the recessed portion 43*a* having a substantially L-shaped configuration when it is viewed from above but also by a portion of the frame body 43*c*; and, the projecting portion 43*b* is swollen out from the inner portion of the supplying toner housing 32 to thereby form a hollow space. And, as shown in FIG. 4C, in a state where the recognition engaging member 43 is mounted on the engaging member mounting portion 41, when the projecting portion 43*b* is cut away, the developer within the supplying toner housing 32, that is, previously loaded and stored toner T for supply is allowed to leak to the outside.

In this manner, when the projecting portion 43*b* of the recognition engaging member 43 is cut away in order to mount an incompatible toner cartridge 30 into the apparatus main body 1, the toner T leaks to the outside to make it difficult to use the recognition engaging member 43, thereby being able to reduce the change of the shape of the recognition engaging member 43.

By the way, in the illustrated preferred embodiment, the projecting portion 43*b*, as described above, is structured such that the whole of the portion thereof that is enclosed by the frame body 43*c* and recessed portion 43*a* is formed to project. However, there another structure may also be used in which at least part of the projecting portion 43*b* is projected, provided that, when cut away, the projecting portion 43*b* is allowed to communicate with the opening 41*b*.

To recognize compatibility between the apparatus main body 1 and toner cartridge 30 using the above structured compatibility recognition structure, as described above, the toner cartridge 30 is mounted onto the white arrow direction X1 by opening the opening/closing door 1*a* provided on the front surface side of the apparatus main body 1. When the apparatus main body 1 and toner cartridge 30 are compatible, that is, when the recognition projecting member 42 and recognition engaging member 43 are mounted in such a mounting state as shown in FIGS. 3A to 4C, the recognition projecting member 42 is engaged with the recessed portion 43*a* of the recognition engaging member 43 and the toner cartridge 30 is mounted up to a given position, whereby the use of the mechanical and electrical connection thereof is made possible, the closing of the opening/closing door 1*a* is possible, and thus the use of the image forming apparatus A is allowed.

On the other hand, when an incompatible toner cartridge 30 is mounted, the recognition projecting member 42 is butted against the projecting portion 43*a* of the recognition engaging member 43 to thereby make impossible the engagement of the recognition projecting member 42 into the recessed portion 43*a*, the toner cartridge 30 cannot be mounted up to the given position, whereby, for example, the electrical connection is made impossible, or the connection between the couplings 33*b*, 37*a* and their drive source cannot be attained, or the opening/closing 1*a* cannot be closed, with the result that the use of the image forming apparatus A is impossible.

This can prevent the mounting of an incompatible toner cartridge 30 onto the apparatus main body 1.

Also, since, on the mounting direction front end surface 39 of the toner cartridge 30 and the inner surface 1*b* of the apparatus main body disposed opposed thereto, there are respectively provided compatibility recognition members, that is, the recognition engaging member 43 and recognition projecting member 42, without obstructing the saving of the space of the apparatus main body 1 in the height direction thereof, the recognition of compatibility between the apparatus main body 1 and toner cartridge 30 is possible.

Next, description will be given below of another method for mounting the recognition projecting member 42 and recognition engaging member 43 of the above-structured compatibility recognition structure with reference to FIGS. 5A to 5C.

Here, structural elements in this example, which are similar in structure to those used in the example previously described based on FIGS. 3A to 4C, are given the same designations and thus the description thereof is omitted here.

FIG. 5A shows the mounting state of the recognition engaging member 43 mounted in a state where it is rotated 90 degrees clockwise from the mounting state shown in FIG. 4A; and in FIG. 5A, the recognition projecting member 42 is also fixed so as to correspond to the mounting state of the recognition engaging member 43, whereby it can be engaged with the recessed portion 43*a* of the engaging member 43.

Also, FIG. 5B, similarly to the above, shows the mounting state of the recognition engaging member 43 mounted in a state where it is rotated 90 degrees clockwise from the mounting state of FIG. 5A; and in FIG. 5B, the recognition projecting member 42 is also fixed so as to correspond to the mounting state of the recognition engaging member 43, whereby it can be engaged with the recessed portion 43*a* of the engaging member 43.

Further, FIG. 5C similarly to the above, shows the mounting state of the recognition engaging member 43 mounted in a state where it is rotated 90 degrees clockwise from the mounting state of FIG. 5B; and in FIG. 5C, the recognition projecting member 42 is also fixed so as to correspond to the mounting state of the recognition engaging member 43, whereby it can be engaged with the recessed portion 43*a* of the engaging member 43.

Thus, according to the above-mentioned structure, even when the recognition projecting member 42 and recognition engaging member 43 have the same shape, at least four sets of combinations for recognition of compatibility are possible, which makes it possible to provide advantages that the number of parts used in the compatibility recognition structure can be reduced as well as the cost thereof can be reduced.

Figure 6A:
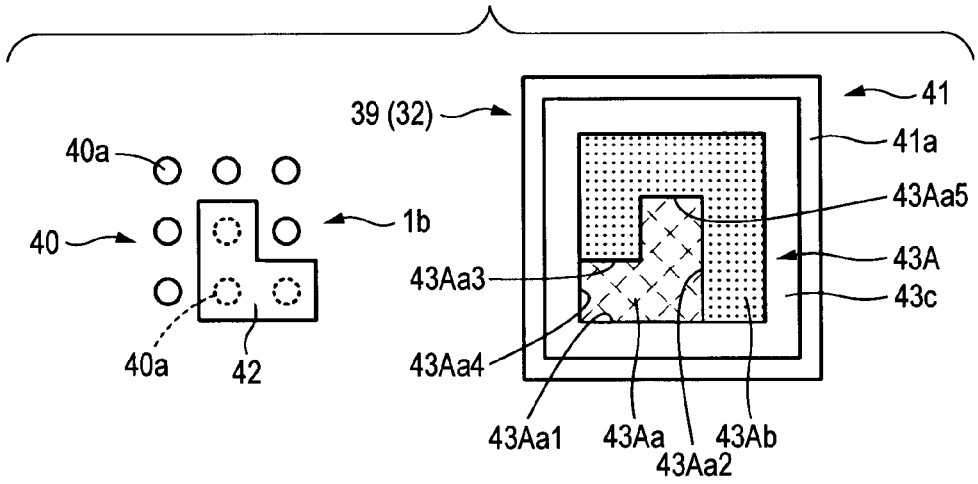
FIGS. 6A, 6B and 6C are schematic typical plan views of other preferred embodiments of the recognition engaging member including a recessed portion having a substantially L-shaped configuration, and the recognition projecting member to be mounted in correspondence to such recognition engaging member.
Figure 6B:
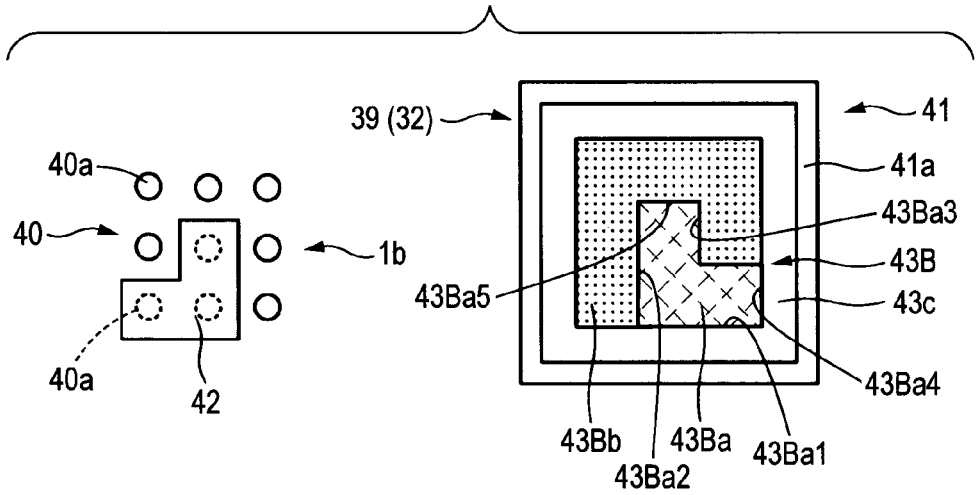
Figure 6C:
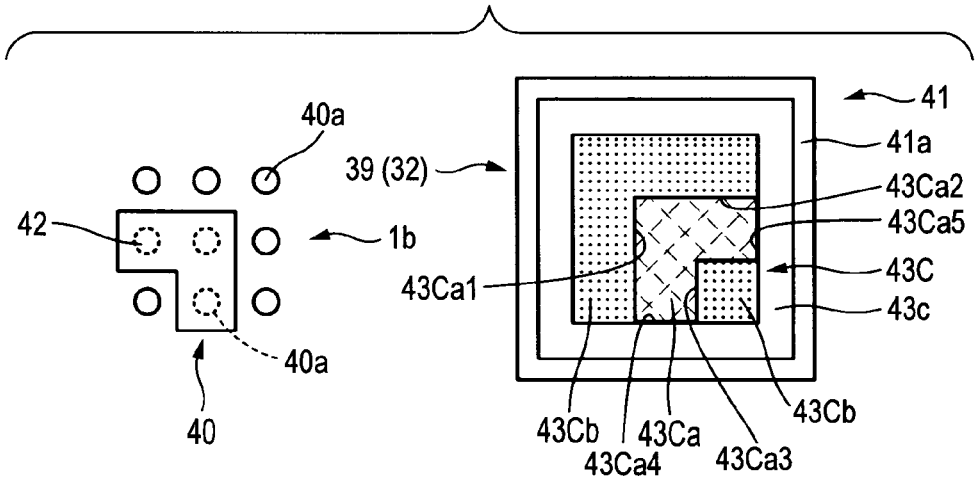

Next, description will be made below of other preferred embodiments of the above-mentioned recognition engaging member. FIGS. 6A, 6B and 6C are respectively typical plan views of the other preferred embodiments of the recognition engaging member in which the recessed portion thereof is formed to have a substantially L-shaped configuration, while a recognition projecting member is mounted so as to correspond to the respective preferred embodiments of the recognition engaging member.

In FIGS. 6A to 6C, elements which are similar in structure to those used in the example previously described based on FIGS. 3A to 4C, are given the same designations and thus the description thereof is omitted here.

In a recognition engaging member 43A shown in FIG. 6A, a recessed portion 43Aa having a substantially L-shaped configuration when it is viewed from above in which, of the bent outer sides thereof, a side 43Aa1 and one end side 43Aa4 respectively extend along a frame body 43*c*; and, a projecting portion 43Ab preferably has a hook-like shape when it is viewed from above which is enclosed by, of the bent outer sides of the recessed portion 43Aa having substantially L-shaped configuration when it is viewed from above, the other side 43Aa2, an inner side 43Aa3, the other side 43Aa5 and a portion of the frame body 43*c*. And, the recognition engaging member 43A is swollen out from the inside portion of a supplying toner housing 32 to thereby provide a hollow similarly to the above-mentioned recognition engaging member 43.

A recognition engaging member 43B shown in FIG. 6B is formed to have a shape obtained by reversing the recognition engaging member 43A shown in FIG. 6A in the right and left direction with respect to the center line thereof. In the recognition engaging member 43B shown in FIG. 6B, a recessed portion 43Ba preferably has a substantially L-shaped configuration when it is viewed from above in which, of the bent outer sides thereof, a side 43Ba1 and one end side 43Ba4 respectively extend along a frame body 43*c*; and, a projecting portion 43Bb preferably has a hook-like shape when it is viewed from above which is enclosed by, of the bent outer sides of the recessed portion 43Ba having substantially L-shaped configuration when it is viewed from above, the other side 43Ba2, an inner side 43Ba3, the other side 43Ba5 and a portion of the frame body 43*c*. And, the recognition engaging member 43B is swollen out from the inside portion of a supplying toner housing 32 to thereby provide a hollow similarly to the above-mentioned recognition engaging member 43.

In a recognition engaging member 43C shown in FIG. 6C, a recessed portion 43Ca preferably has a substantially L-shaped configuration when it is viewed from above in which two end sides 43Ca4 and 43Ca5 extend along a frame body 43*c*; and, a projecting portion 43Cb is formed to have a shape including a first portion which is enclosed by the bent outer sides 43Ca1, 43Ca2 of the recessed portion 43Ca having a substantially L-shaped configuration when it is viewed from above and has a substantially L-shaped configuration when it is viewed from above, and a second portion which is enclosed by the bent inner side 43Ca3 and a portion of the frame body 43C and has a substantially square shape when it is viewed from above. And, the recognition engaging member 43C is swollen out from the inside portion of the supplying toner housing 32, thereby providing a hollow similarly to the above-mentioned recognition engaging member 43.

In the above-structured recognition engaging members 43A, 43B and 43C as well, similarly to the recognition engaging member 43 which has been previously discussed with reference to FIGS. 5A to 5C, by rotating by 90 degrees, they can be mounted in four kinds of mounting states respectively. When the recognition projecting member 42 is mounted so as to correspond to the respective mounting states, there are possible four sets of combinations for recognition of the compatibility respectively.

As described above, the securing holes 40*a* are arranged such that they are situated at least at the positions of the four vertices of a square, the nine securing holes 40*a* are used to constitute the projecting member mounting portion 40, four of the nine securing holes 40*a* are situated at the four vertices positions of a square and the remaining five securing holes 40*a* are set at the equidistant positions from these four vertices positions to thereby constitute the projecting member mounting portion 40, and the recognition projecting member 42 and recessed portion 43*a* are respectively formed to have a substantially L-shaped configuration when viewed from above. Thus, the recessed portion 43*a*, which is to be formed in the recognition projecting member 43 so as to have a substantially L-shaped configuration when viewed from above, as described above, can be formed in four forming patterns, that is, in patterns 43*a*, 43Aa, 43Ba and 43Ca. Therefore, even when the shape of the recognition projecting member 42 remains unchanged, simply by changing the shape of the recognition engaging member 43, the number of combinations for recognition of compatibility can be increased, which makes it possible to reduce the number of parts used in the compatibility recognition structure as well as the cost thereof.

Next, description will be given below of another preferred embodiment of a compatibility recognition structure applicable to the image forming apparatus according to the present invention with reference to FIGS. 7A to 7C. Specifically, FIGS. 7A, 7B and 7C are respectively typical plan views of other preferred embodiments of the recognition engaging member and recognition projecting member.

Figure 7A:
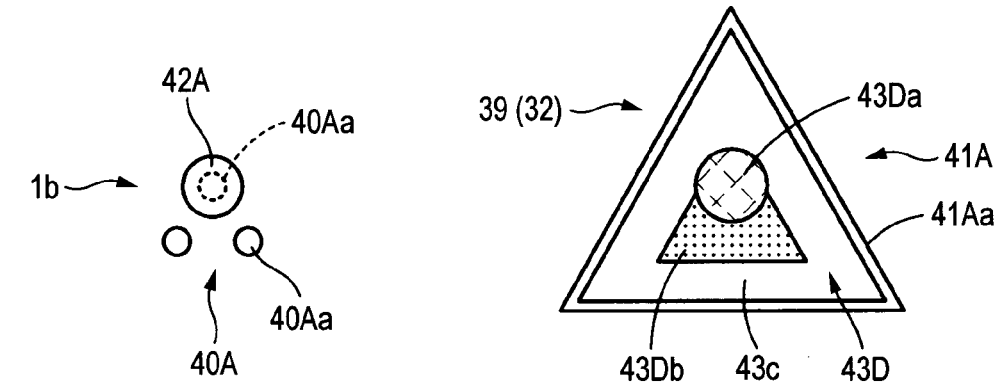
FIGS. 7A, 7B and 7C are schematic typical plan views of other preferred embodiments of the recognition engaging member and recognition projecting member.
Figure 7B:
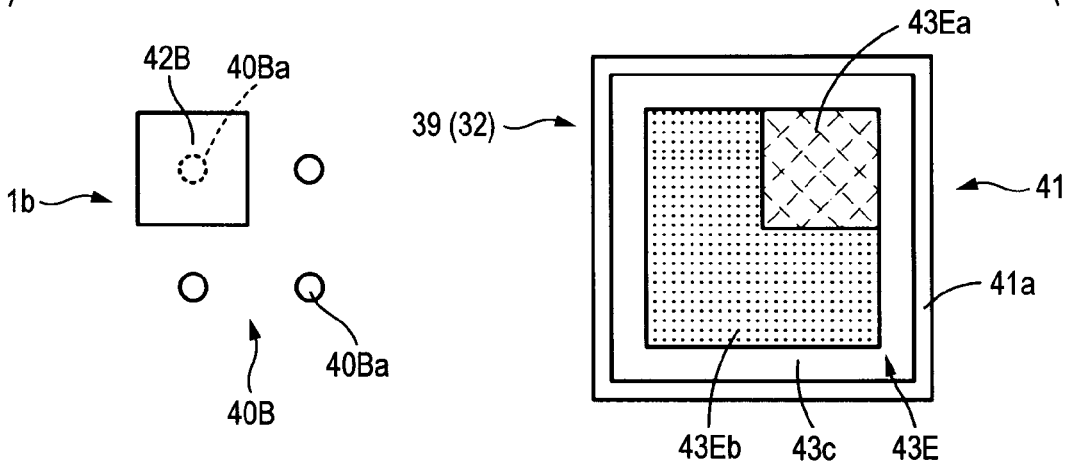
Figure 7C:
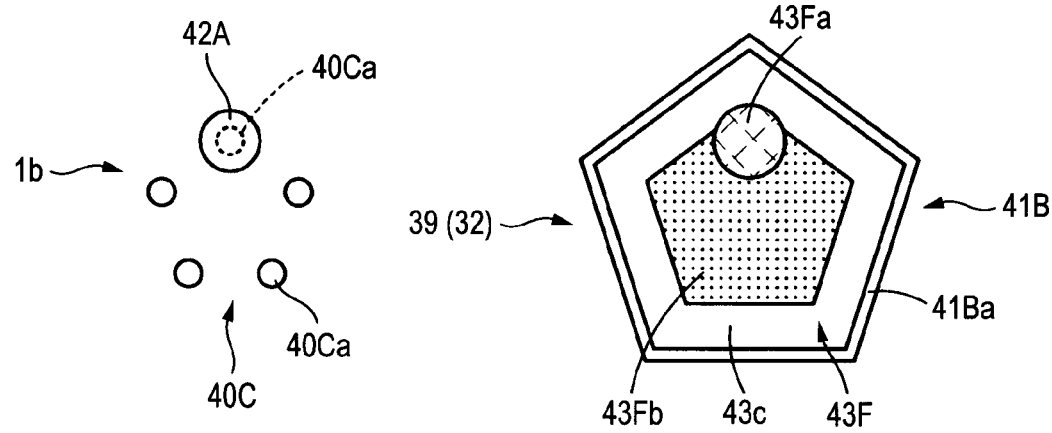

In FIGS. 7A to 7C, parts similar in structure to those used in FIGS. 3A to 4C are given the same designations and thus the duplicate description thereof is omitted here.

In the preferred embodiment shown in FIG. 7A, there are formed three securing holes 40Aa which cooperate together in constituting a projecting member mounting portion 40A in such a manner that they are respectively situated at the vertices positions of an equilateral triangle; and, to one of these securing holes 40Aa, there is fixed a recognition projecting member 42A which preferably has a substantially cylindrical shape.

According to this preferred embodiment, by changing the mounting position of the recognition projecting member 42A to be fixed to the three securing holes 40Aa, the recognition projecting member 42A can be mounted in three mounting states.

On an engaging member mounting portion 41A, there is provided a mounting frame 41Aa having an equilateral triangle shape so as to correspond to the three securing holes 40Aa respectively formed at the three vertices positions of the above-mentioned equilateral triangle; and, on the inside of the mounting frame 41Aa, there is mounted a recognition engaging member 43D.

The recognition engaging member 43D is formed in an equilateral triangle shape as a whole; and, it includes a frame body 43*c*, a recessed portion 43Da which is formed inside the frame body 43*c* so as to have a substantially circular shape when it is viewed from above and can be engaged with the recognition projecting member 42A, and a projecting portion 43Db formed by projecting the portion of the recognition engaging member 43D that is enclosed by the recessed portion 43Da and a portion of the frame body 43*c*.

According to this preferred embodiment, by mounting the recognition engaging member 43D while rotating it 120 degrees, it can be mounted in three mounting states.

According to a preferred embodiment shown in FIG. 7B, there are formed four securing holes 40Ba which cooperate together in constituting a projecting member mounting portion 40B in such a manner that they are respectively present at the respective vertices positions of a square; and, to one of the four securing holes 40Ba, there is fixed a recognition projecting member 42B which is formed to have a prism shape.

According to this preferred embodiment, by changing the mounting position of the recognition projecting member 42B to be fixed to the four securing holes 40Ba, the recognition projecting member 42B can be mounted in four mounting states.

An engaging member mounting portion 41 includes a mounting frame 41*a* which is provided on and projected therefrom and has a substantially square shape so as to correspond to the four securing holes 40Ba respectively formed at the four vertices positions of the above-mentioned square. And, on the inside of the mounting frame 41*a*, there is mounted a recognition engaging member 43E.

The recognition engaging member 43E preferably has a substantially square shape as a whole and includes a frame body 43*c*; a recessed portion 43Ea which is formed inside the frame body 43*c* in a square shape when it is viewed from above and can be engaged with a recognition projecting member 42B; and, a projecting portion 43Eb which is formed by projecting the portion of the recognition engaging member 43E that is enclosed by the recessed portion 43Ea and a portion of the frame body 43*c*.

According to this preferred embodiment, by mounting the recognition engaging member 43E while rotating it 90 degrees similarly to the recognition engaging member 43, the recognition engaging member 43E can be mounted in four mounting states.

According to a preferred embodiment shown in FIG. 7C, there are formed five securing holes 40Ca which cooperate together in constituting a projecting member mounting portion 40C in such a manner that they are respectively present at the five vertices positions of a regular pentagon; and, to one of the five securing holes 40Ca, there is fixed a recognition projecting member 42A which preferably has a substantially cylindrical shape.

According to the present preferred embodiment, by changing the mounting position of the recognition projecting member 42A to be fixed to the five securing holes 40Ca, the recognition projecting member 42A can be mounted in five mounting states.

An engaging member mounting portion 41B includes a mounting frame 41Ba which projects in a substantially regular pentagonal shape so as to correspond to the five securing holes 40Ca respectively formed at the five vertices positions of the above-mentioned regular pentagon; and, on the inside of the mounting frame 41Ba, there is mounted a recognition engaging member 43F.

The recognition engaging member 43F, which is formed in a regular pentagon shape as a whole, preferably includes a frame body 43*c*; a recessed portion 43Fa which is formed inside the frame body 43*c* in a substantially circular shape when it is viewed from above and can be engaged with the recognition projecting member 42A; and, a projecting portion 43Fb which is formed by projecting the portion of the recognition engaging member 43F that is enclosed by the recessed portion 43Fa and a portion of the frame body 43*c*.

According to the present preferred embodiment, by mounting the recognition engaging member 43F while rotating it by about 72 degrees, it can be mounted in five mounting states.

According the above-described preferred embodiments respectively shown in FIGS. 7A to 7C, the securing holes, which constitute the projecting member mounting portion, are formed so as to be present at the vertices positions of the regular polygon, the recognition projecting member can be mounted in such mounting states corresponding to the number of the vertices of the respective regular polygons, and the recognition engaging member, in correspondence to the mounting states of the recognition projecting member, can also be mounted in such mounting states corresponding to the number of the vertices of the respective regular polygons. Therefore, even when the recognition projecting member and recognition engaging member have the same shape, there can be obtained such number of sets of combinations for compatibility recognition corresponding to the number of the vertices of the regular polygons. Specifically, for an equilateral triangle, since it has three vertices, three sets of combination are possible; for a square, since it has four vertices, four sets of combination are possible; and, for a regular pentagon, it has five vertices, five sets of combination are possible. This provides an advantage that not only the number of parts used in the compatibility recognition structure but also the cost thereof can be reduced.

Generally, there are often developed two or more kinds of image forming process units according to two or more kinds of image forming apparatus developed from the technological view point such as resolution or according to the kinds of the performance of the image forming process units themselves. According to the present preferred embodiment, there is illustrated the toner cartridge 30 as an image forming process unit capable of compatibility recognition. However, the present invention is not limited to this but can also be applied to a process unit made of the developing device main body unit 80, a process unit made of the drum unit 50, or a process unit which includes both of them as a package.

Also, there have been illustrated heretofore not only the preferred embodiment in which the securing holes constituting the projecting member mounting portion are respectively formed at least at the positions of the vertices of a regular polygon, but also the preferred embodiment in which engaging member mounting portion includes an opening, the recognition engaging member includes a projecting portion, and, by cutting away the projecting portion, the developer is allowed to leak. However, the shapes of the projecting member mounting portion, recognition projecting member, engaging member mounting portion and recognition engaging member are not limited to the illustrated ones, but they may have any shapes, provided that they can mount the recognition projecting member and recognition engaging member respectively in two or more mounting states.

Further, although, according to the respective illustrated preferred embodiments, the shape of the recognition projecting member and the shape of the recessed portion of the recognition engaging member are preferably the same when viewed from above, a recognition projecting member and a recessed portion, which have different shapes from each other when viewed from above, may also be engaged with each other. That is, the recessed portion may be formed at least larger in size than the recognition projecting member.

Still further, description has been given heretofore of the preferred embodiment in which the process units 50, 80 and toner cartridge 30 are mounted into the apparatus main body 1 from the front surface side of the apparatus main body 1. However, the present invention can also be applied to a case where they are mounted into the apparatus main body 1 from the right or left side surface side thereof or from the back surface side thereof.

While the present invention has been described with respect to preferred embodiments thereof, it will be apparent to those skilled in the art that the disclosed invention may be modified in numerous ways and may assume many embodiments other than those specifically set out and described above. Accordingly, it is intended by the appended claims to cover all modifications of the present invention that fall within the true spirit and scope of the present invention.

What is claimed is:

1. An image forming apparatus for recognizing compatibility of an image forming process unit to be removably mounted at a given position within a main body of the apparatus, the image forming apparatus comprising:

an engaging member mounting portion arranged to mount a recognition engaging member thereon and arranged in a mounting direction front end surface of the image forming process unit; and a projecting member mounting portion arranged to mount thereon a recognition projecting member engageable with a recessed portion provided in the recognition engaging member and arranged in an inner surface of the apparatus main body to be disposed opposite to the engaging member mounting portion in a state in which the image forming process unit is mounted; wherein the projecting member mounting portion and the recognition engaging member mounting portion are respectively capable of mounting the recognition projecting member and recognition engaging member in at least two mounting states;

the recognition projecting member and the recognition engaging member are mounted in such a mounting state so as to allow the recognition projecting member and the recognition engaging member to be engaged with each other in the at least two mounting states so as to achieve compatibility recognition; and the engaging member mounting portion includes an opening allowing the developer of the image forming unit to leak therefrom, the recognition engaging member is mounted so as to close the opening and includes a hollow projecting portion in the vicinity of the recessed portion, and when the projecting portion is cut away, the developer leaks to the outside.

2. The image forming apparatus according to claim 1, wherein the image forming process unit includes at least one of a toner cartridge and a developing device unit.

3. The image forming apparatus according to claim 1, wherein the recognition projecting member is mounted on the projecting member mounting portion via a fastener, the projecting member mounting portion includes at least two securing holes for securing the fastener thereto, and the at least two securing holes are respectively located at least at the vertices positions of a regular polygon.

4. The image forming apparatus according to claim 3, wherein the regular polygon has a substantially square-shaped configuration, the projecting member mounting portion includes nine securing holes, four of the nine securing holes are respectively located at the vertices positions of the square and the remaining five of the nine securing holes are respectively disposed at substantially equidistant positions from the vertices positions; and the recognition projecting member has a substantially L-shaped configuration when viewed from above so as to correspond to three of the securing holes, and the recessed portion of the recognition engaging member has a shape corresponding to the shape of the recognition projecting member.

* * * * *